US007343642B2

(12) United States Patent
Streciwilk

(10) Patent No.: US 7,343,642 B2
(45) Date of Patent: Mar. 18, 2008

(54) VACUUM CLEANER WITH DIRT VESSEL AND SEPARATE FILTER ASSEMBLY

(75) Inventor: Eric J. Streciwilk, Perryville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 754 days.

(21) Appl. No.: 10/686,917

(22) Filed: Oct. 16, 2003

(65) Prior Publication Data

US 2004/0078923 A1 Apr. 29, 2004

Related U.S. Application Data

(60) Provisional application No. 60/420,665, filed on Oct. 23, 2002.

(51) Int. Cl.
*A47L 9/10* (2006.01)

(52) U.S. Cl. ..... 15/352; 15/353; 55/429; 55/DIG. 3

(58) Field of Classification Search ..... None
See application file for complete search history.

(56) References Cited

U.S. PATENT DOCUMENTS

| | | | | |
|---|---|---|---|---|
| 5,307,538 | A * | 5/1994 | Rench et al. | 15/352 |
| 6,260,234 | B1 | 7/2001 | Wright et al. | |
| 6,353,963 | B1 | 3/2002 | Bair et al. | |
| 6,358,290 | B1 | 3/2002 | Huttlin | |
| 6,391,095 | B1 | 5/2002 | Conrad et al. | |
| 6,401,295 | B2 | 6/2002 | Bair et al. | |
| 6,591,446 | B2 | 7/2003 | Bair et al. | |
| 6,810,557 | B2 * | 11/2004 | Hansen et al. | 15/353 |

* cited by examiner

*Primary Examiner*—David A Redding
(74) *Attorney, Agent, or Firm*—King & Schickli, PLLC

(57) ABSTRACT

A vacuum cleaner includes a housing, a nozzle inlet, a suction generator carried on the housing and a dirt collection assembly carried on the housing. The dirt collection assembly includes (a) a dirt vessel having an outer sidewall, an inner sidewall, a bottom wall, an inlet and an open end and (b) a filter assembly including a base that covers the open end of the dirt vessel, a manifold housing, a filter chamber and a filter element held in the filter chamber.

14 Claims, 2 Drawing Sheets

VACUUM CLEANER WITH DIRT VESSEL AND SEPARATE FILTER ASSEMBLY

This application claims the benefit of U.S. Provisional Patent Application Ser. No. 60/420,665 filed Oct. 23, 2002.

TECHNICAL FIELD

The present invention relates generally to the floor care equipment field and, more particularly, to a vacuum cleaner incorporating a novel dirt collection assembly and that novel dirt collection assembly.

BACKGROUND OF THE INVENTION

Bagless vacuum cleaner technology has long been known in the art. Japanese Patent Applications 56-136642 and 56-136650 both published in 1981 disclose an upright vacuum cleaner with a dust collection chamber that removably connects to an opening of the main unit to facilitate user convenience during the emptying of the cleaner. A removable filter fills an opening at the bottom of the dust chamber and serves to separate dust from air drawn through the vacuum cleaner by the fan and motor assembly.

The present invention relates to an improved dirt collection assembly for an upright or canister vacuum cleaner.

SUMMARY OF THE INVENTION

In accordance with the purposes of the present invention as described herein, a new and improved vacuum cleaner is provided. That vacuum cleaner includes a housing, a nozzle inlet, a suction generator carried on the housing and a dirt collection assembly carried on the housing. The dirt collection assembly includes a dirt vessel having an outer sidewall, an inner sidewall, a bottom wall, an inlet and an open end. Additionally, the dirt collection assembly includes a filter assembly including a base that covers the open end of the dirt vessel, a manifold housing, a filter chamber and a filter element held in the filter chamber.

More specifically describing the invention, the filter element is annular in shape. Further, the filter assembly includes a frustoconical air guide that directs air through the filter element. That air guide includes a discharge opening that is in fluid communication with a discharge passageway provided in the dirt vessel. The air guide also includes a first channel and the base includes a second channel. The filter element is held in and extends between these two channels. In addition, the base includes a screen section allowing the passage of air through the base from the dirt collection chamber.

The dirt collection chamber is annular and the inner and outer sidewall are substantially circular in cross section. The inlet is provided in the outer sidewall and is oriented substantially tangentially with respect to the outer sidewall.

The dirt collection assembly includes a unique geometry wherein the inner sidewall is concentrically received in the base. The screen section of the base is concentrically received around the inner sidewall. The filter element is concentrically received around the screen section. The frustoconical surface of the air guide is concentrically received within the filter element. Further, the inner sidewall defines the discharge passageway through the dirt vessel.

The filter element may include a support frame and a pleated filter media. Additionally, in one embodiment the housing includes a nozzle section, including the nozzle inlet, and a canister section. The nozzle section and the canister section are pivotally connected together in order to form an upright vacuum cleaner.

In accordance with an additional aspect of the present invention a method is provided of directing air through an annular filter element. The method comprises routing air radially outwardly through the annular filter element and discharging air axially through a center opening in the annular filter element. Accordingly, air is fed into and discharged from the annular filter element through the center opening of that filter element.

In accordance with yet another aspect of the present invention, a dirt collection assembly is provided. The dirt collection assembly includes a dirt cup including an outer sidewall, an inner sidewall, a bottom wall, an inlet and an open end. Additionally, the dirt collection assembly includes a filter assembly including a partition that seats over the open end of the dirt cup, a housing and a filter element. The housing and the partition define a filter chamber for holding the filter element.

In the following description there is shown and described a preferred embodiment of the invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of this specification, illustrates several aspects of the present invention, and together with the description serves to explain certain principles of the invention. In the drawing.

Reference will now be made in detail to the present preferred embodiment of the invention, an example of which is illustrated in the accompanying drawing.

DETAILED DESCRIPTION OF THE INVENTION

Figure 1:
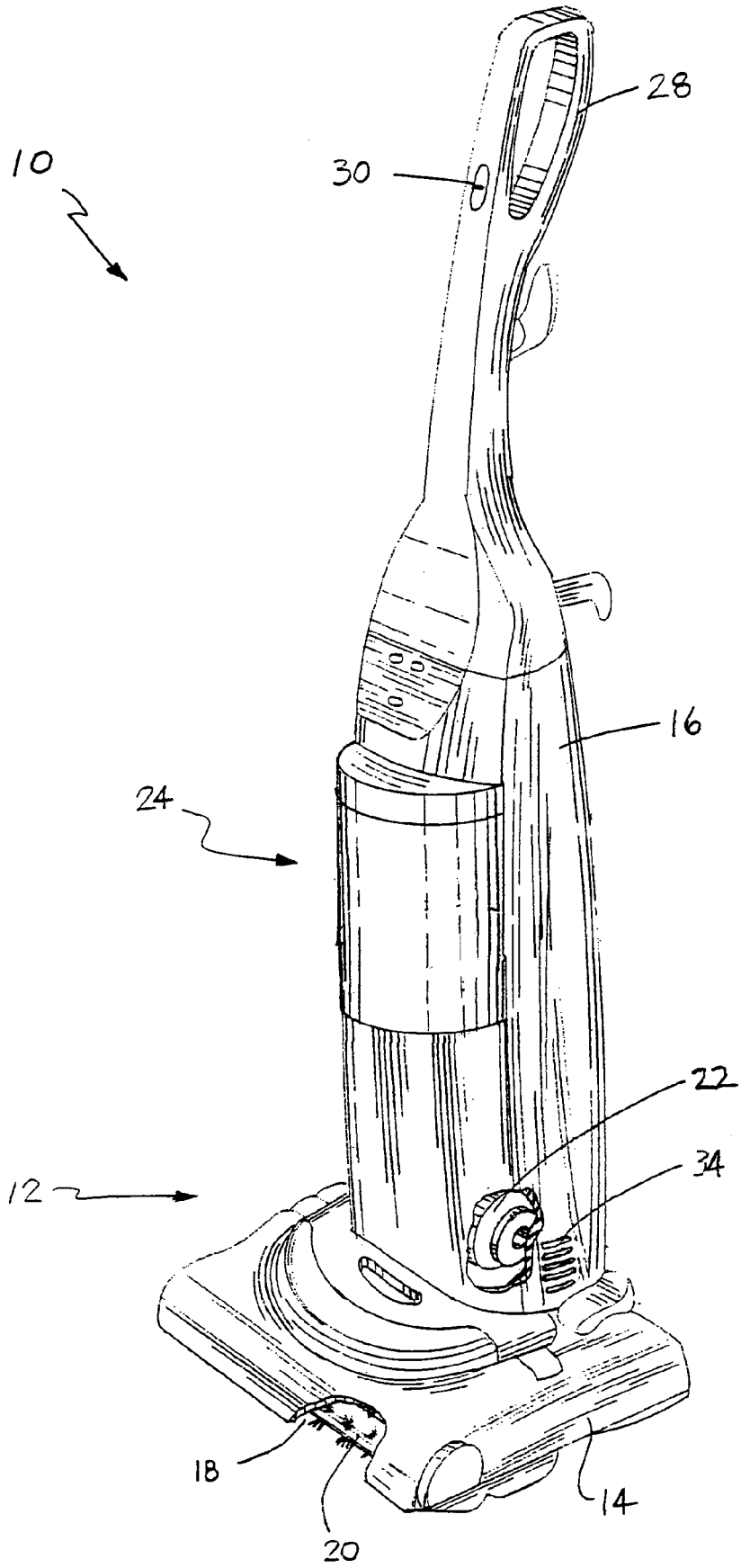
FIG. 1 is a perspective view of one possible embodiment of a vacuum cleaner of the present invention.

Reference is now made to FIG. 1 illustrating one possible embodiment of the vacuum cleaner 10 of the present invention. The illustrated embodiment is an upright vacuum cleaner 10. It should be appreciated, however, that the present invention also includes and this patent also covers canister and hand-held vacuum cleaners.

The vacuum cleaner 10 includes a housing, generally designated by reference numeral 12, including a nozzle section 14 and a canister section 16. As is known in the art, the canister section 16 is pivotally connected to the nozzle section 14 to aid the operator in manipulating the vacuum cleaner to and fro across the floor. Wheels (not shown) carried on the housing 12 allow the vacuum cleaner 10 to be moved smoothly across the floor. As illustrated, the nozzle section 14 is equipped with a nozzle inlet 18. In the illustrated embodiment, the nozzle inlet 18 also includes a rotary agitator 20.

The canister section 16 houses a suction generator 22 (i.e. a fan and motor assembly) and a dirt vessel 24 having a dirt collection chamber 26. The canister section 16 also includes a control handle 28 and an actuator switch 30 for turning the vacuum cleaner 10 on and off and thereby driving the rotary agitator 20 and the suction generator 22.

During the cleaning operation the rotary agitator 20 brushes and beats dirt and debris from the nap of an underlying carpet being cleaned. The dirt and debris are then drawn by the suction generator 22 through the nozzle inlet 18 into the dirt vessel 24 and through the filter element 32. Dirt and debris are collected in the dirt collection chamber 26. The airstream is then directed over the motor of the suction generator 22 to provide cooling before being routed through a final filter, to remove any carbon particles stripped from the brushes of the motor by the airstream, before exhausting the airstream through an exhaust port 34 into the environment.

Figure 2:
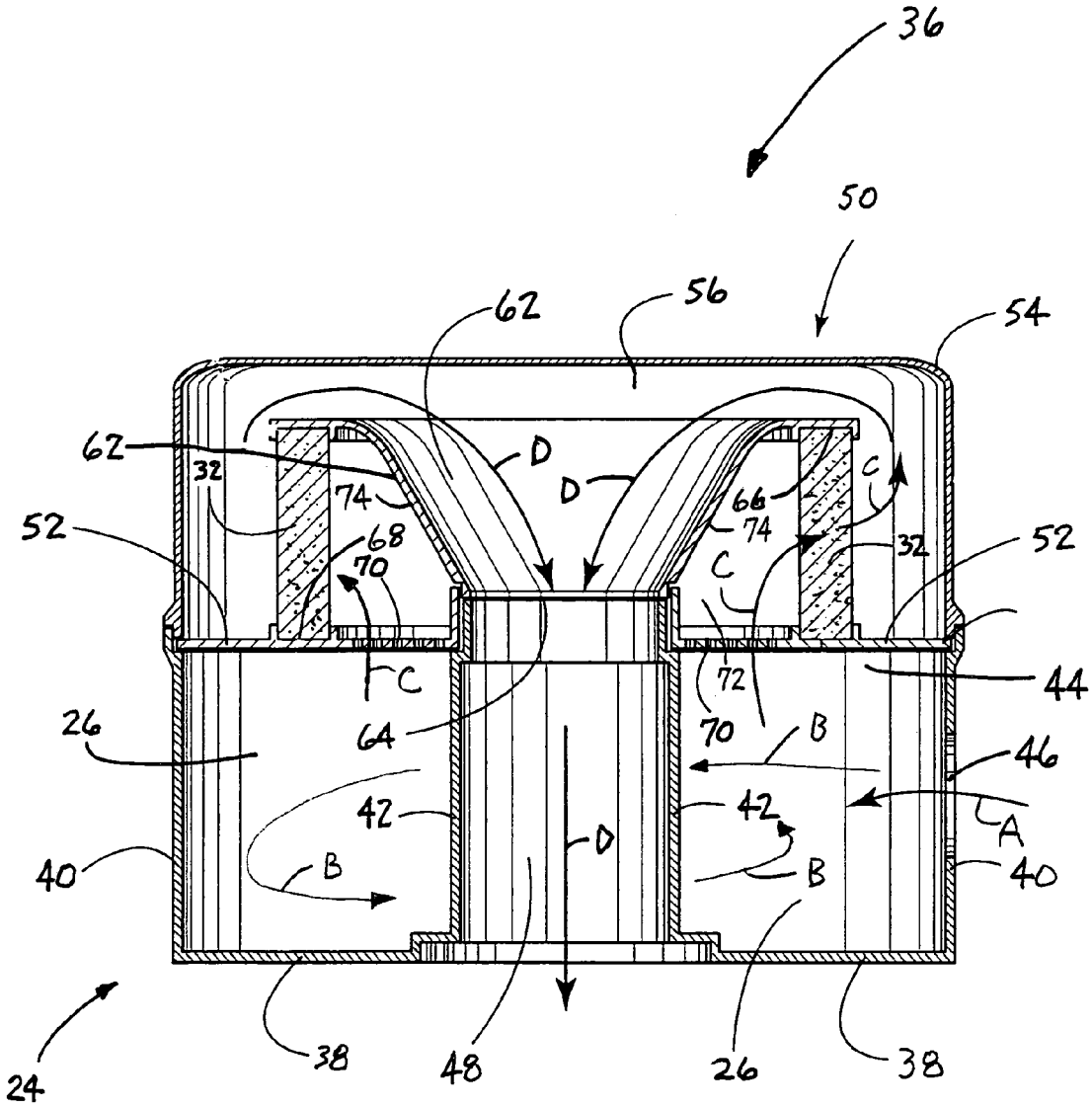
FIG. 2 is a detailed, partially schematical and cross-sectional view of the dirt collection assembly.

The dirt collection assembly 36 is best illustrated in FIG. 2. The dirt collection assembly 36 includes the dirt vessel 24. Dirt vessel 24 has a bottom wall 38, an outer sidewall 40, an inner sidewall 42 and an open end 44. An air inlet 46 is provided in the outer sidewall. A discharge passageway 48 is formed in the lumen of the inner sidewall 42.

In the illustrated embodiment, both the inner sidewall 42 and outer sidewall 40 are circular in cross section. Accordingly, the dirt collection chamber 26 provided in the dirt vessel 24 is annular in shape. Where the air inlet 46 is tangentially directed with respect to the outer sidewall 40, cyclonic airflow is established within the dirt collection chamber 26. For many applications such airflow increases the cleaning efficiency of the vacuum cleaner by aiding in the separation of dirt and debris from the airstream.

The filter assembly 50 includes a base 52 that covers the open end 44 of the dirt vessel 24, a manifold housing 54 and a filter chamber 56 formed between the base and the manifold housing for holding the filter element 32.

In the illustrated embodiment, the filter element 32 is annular in shape. In the illustrated embodiment, the filter element 32 comprises a support frame and a pleated filter media of a type known to be useful for separating dirt and debris from an airstream in a vacuum cleaner that is held in the filter frame. Of course, filter elements of alternative design could be utilized including, for example, any form of filter media sandwiched between two screens.

As further illustrated in FIG. 2, the filter assembly 50 also includes a frustoconical air guide 62 that directs air through the filter element 32 in a manner that will be described in greater detail below. The air guide 62 includes a discharge opening 64 that is aligned and in fluid communication with the discharge passageway 48 provided in the dirt vessel 24.

As further illustrated in FIG. 2, the air guide includes a first channel 66. The base 52 includes a second channel 68. The first and second channels 66, 68 are annular in shape and of the same dimensions. The filter element 32 is received and held in these two channels 66, 68.

As should be further appreciated, the base 52 includes a screen, vent or air passage section 70. Air passes from the open end 44 of the dirt vessel 24 through the screen section 70 before passing through the pleated filter media of the filter element 32.

From viewing FIG. 2, it is clear that the inner sidewall 42 is concentrically received in the base 52. The screen section 70 of the base 52 is concentrically received around the inner sidewall 42. The filter element 32 is concentrically received around the screen section 70. Additionally, at least a portion of the frustoconical air guide 62 is concentrically received within the filter element 32.

In operation, the receiver assembly 20 beats dirt and debris from the nap of an underlying carpet being cleaned. The suction generator 22 creates a negative pressure that draws an airstream along with that dirt and debris into the suction inlet 18. The airstream is then routed through pipes and/or hoses to the air inlet 46 (note action arrow A). The airstream then moves in a cyclonic pattern around the dirt collection chamber 26 (note action arrows B). The airstream is then drawn through the screen section 70 into the central opening 72 of the filter element 32. The air is then directed by the outer surface 74 of the frustoconical air guide 62 through the pleated filter media of the filter element 32 (note actions arrow C).

Next, the air is drawn in the direction of action arrows D over the top of the filter element 32 and down through the frustoconical air guide 62 through the discharge opening 64 and the discharge passageway 48. Next the air flows over the motor of the suction generator 22 so as to provide desired cooling. The air is then filtered in order to remove any carbon particles that might have been picked up from the brushes of the suction generator motor before being exhausted into the environment through the exhaust port 34.

At certain times during vacuum cleaner operation it may become necessary to empty the dirt and debris from the dirt collection chamber 26. In order to do that, the dirt collection assembly 36 is removed from the canister section 16. The manifold housing 54 is then twisted so as to release that housing from the dirt vessel 24. The base 52 of the filter assembly 50 is then lifted out of the dirt vessel 24 thereby exposing the open end 44. The dirt vessel is then inverted over a garbage can or trash bag in order to dump the dirt and debris from the dirt collection chamber 26. If necessary, the filter element 32 may be removed from the filter assembly 50 and cleaned or replaced. The various component parts are then reassembled and the dirt collection assembly 36 reinstalled in the canister section 16. The vacuum cleaner 10 is then again ready for operation.

The foregoing description of the preferred embodiments of this invention have been presented for purposes of illustration and description. It is not intended to be exhaustive or to limit the invention to the precise form disclosed. Obvious modifications or variations are possible in light of the above teachings.

For example, while the illustrated embodiment is an upright vacuum cleaner, the present invention also relates to and includes canister and hand-held vacuum cleaners. Further, while the illustrated embodiment is a "clean air" system with the suction generator 22 downstream from the dirt cup 24 and dirt collection chamber 26, the present invention also includes "dirty air" systems where the suction generator is located upstream of either or both of these structures. Further, while the illustrated vacuum cleaner 10 includes one rotary agitator, it could include two or more rotary agitators or none at all.

The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims and their fair and broad interpretation in any way.

What is claimed is:

1. A vacuum cleaner, comprising:

a housing;

a nozzle inlet;

a suction generator carried on said housing; and a dirt collection assembly carried on said housing, said dirt collection assembly including (a) a dirt vessel having an outer sidewall, an inner sidewall, a bottom wall, an inlet and an open end and (b) a filter assembly including a base that covers said open end of said dirt vessel, a manifold housing, a filter chamber, an annular filter element held in said filter chamber and a frustoconical air guide held in said filter chamber that directs air through said filter element.

2. The vacuum cleaner of claim 1, wherein said air guide includes a discharge opening and said dirt vessel includes a discharge passageway, said discharge opening being in fluid communication with said discharge passageway.

3. The vacuum cleaner of claim 2, wherein said air guide includes a first channel and said base includes a second channel, said filter element being held in said first and second channels.

4. The vacuum cleaner of claim 3, wherein said base includes a screen section.

5. The vacuum cleaner of claim 4, wherein an annular dirt collection chamber is provided in said dirt vessel by said outer sidewall, said inner sidewall and said base.

6. The vacuum cleaner of claim 5, wherein said inlet is provided in said outer sidewall and said inlet is oriented substantially tangentially with respect to said outer sidewall.

7. The vacuum cleaner of claim 6, wherein said inner sidewall is concentrically received in said base.

8. The vacuum cleaner of claim 7, wherein said screen section of said base is concentrically received around said inner sidewall.

9. The vacuum cleaner of claim 8, wherein said filter element is concentrically received around said screen section.

10. The vacuum cleaner of claim 9, wherein at least a portion of said frustoconical air guide is concentrically received within said filter element.

11. The vacuum cleaner of claim 10, wherein said inner sidewall defines said discharge passageway.

12. The vacuum cleaner of claim 11, wherein said filter element includes a support frame and a pleated filter media.

13. The vacuum cleaner of claim 12, wherein said housing includes a nozzle section, including said nozzle inlet, and a canister section.

14. The vacuum cleaner of claim 13, wherein said nozzle section and said canister section are pivotally connected together.

* * * * *